US006502580B1

(12) United States Patent
Luparini

(10) Patent No.: US 6,502,580 B1
(45) Date of Patent: Jan. 7, 2003

(54) HYPOBARIC CIGARETTE FILTER DEVICE

(76) Inventor: Alessandro Leonetti Luparini, Via Auriga, 11-00060 Castelnuovo Di Porto (Prov. of Rome) (IT)

( * ) Notice: Subject to any disclaimer, the term of this patent is extended or adjusted under 35 U.S.C. 154(b) by 0 days.

(21) Appl. No.: 09/509,064

(22) PCT Filed: Dec. 31, 1997

(86) PCT No.: PCT/IT97/00318

§ 371 (c)(1),
(2), (4) Date: Mar. 21, 2000

(87) PCT Pub. No.: WO99/15038

PCT Pub. Date: Apr. 1, 1999

(30) Foreign Application Priority Data

Sep. 23, 1997 (IT) ..... RM97A0572

(51) Int. Cl.[7] ..... A24D 1/04; A24D 3/00

(52) U.S. Cl. ..... 131/200; 131/211; 131/212.1; 131/338

(58) Field of Search ..... 131/200, 360, 131/211, 321, 212.7, 212.2, 337, 338

(56) References Cited

U.S. PATENT DOCUMENTS 3,433,231 A * 3/1969 Siragusa ..... 131/10.5
3,525,345 A * 8/1970 Harris ..... 131/261
3,581,748 A * 6/1971 Cameron ..... 131/10.5
3,601,133 A * 8/1971 Van Eck ..... 131/261
3,646,941 A * 3/1972 Doppelt ..... 131/9
3,777,765 A * 12/1973 Yoshinaga ..... 131/187
4,023,576 A * 5/1977 Norman ..... 131/10
4,574,820 A * 3/1986 Pinkerton et al. ..... 131/339

FOREIGN PATENT DOCUMENTS

| | | | |
|---|---|---|---|
| DE | 17908 | * | 4/1882 |
| FR | 1561234 | * | 3/1969 |
| FR | 2040837 | * | 1/1971 |
| GB | 4434 | * | 5/1877 |
| GB | 1257262 | * | 12/1971 |
| GB | 2817 | * | 10/1986 |
| GB | 2289612 | * | 11/1995 |

OTHER PUBLICATIONS

Lazzarino et al, 2001, Anticancer Research, 21:887–892, pp. 887–892.*

* cited by examiner

*Primary Examiner*—Jose Fortuna
*Assistant Examiner*—Carlos Lopez
(74) *Attorney, Agent, or Firm*—Hedman & Costigan, P.C.

(57) ABSTRACT

The invention is a tar retention device for insertion in the smoke path of a cigarette between the point of combustion and the smoker. The device is comprised of a chamber with an inlet duct formed on the side of the point of combustion and outlet side facing the smoker. The inlet duct is narrower than the outlet duct and each duct tapers towards their respective ends inside of the chamber. The difference in dimensions of the inlet and outlet ducts creates a hypobaric action within the chamber causing the deposition of tar within the chamber.

6 Claims, 1 Drawing Sheet

FIG 1
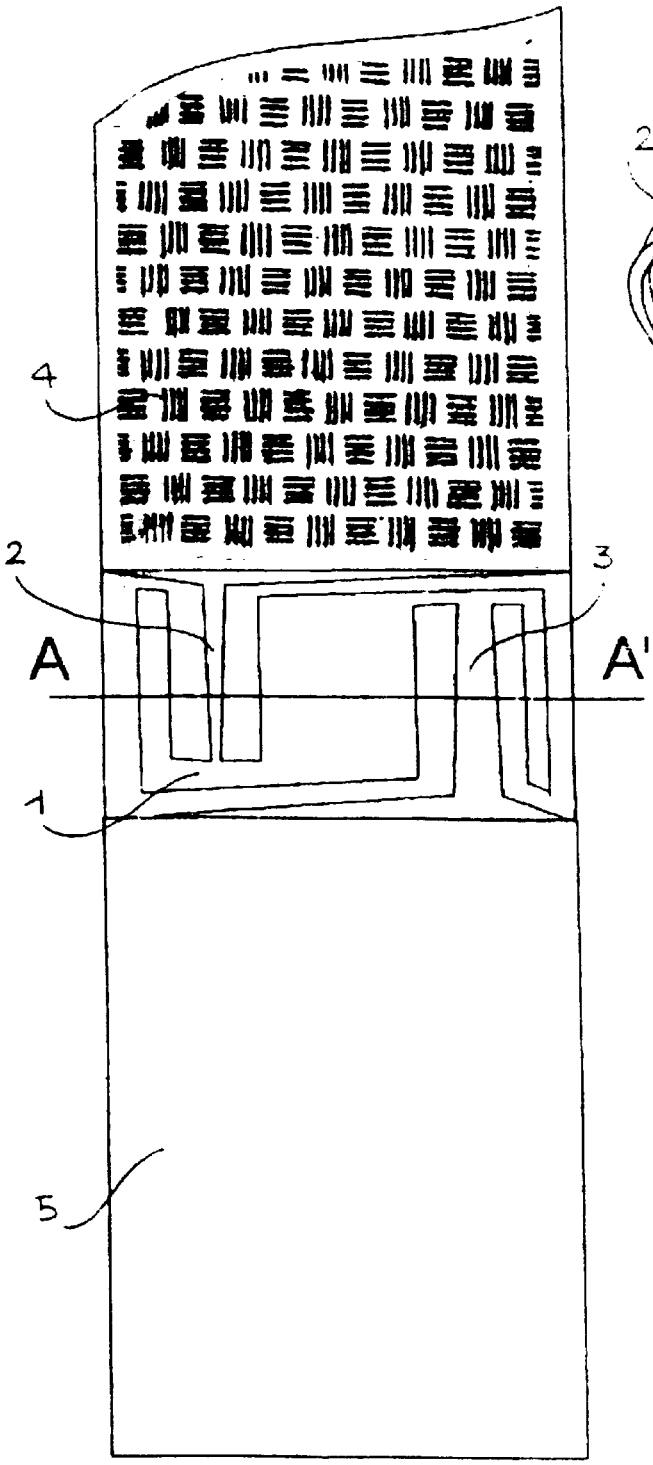
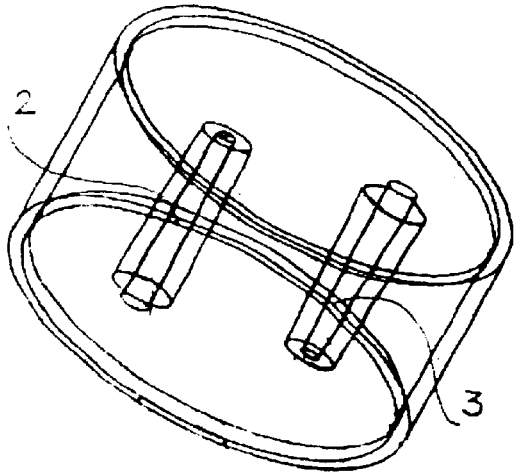
FIG 2
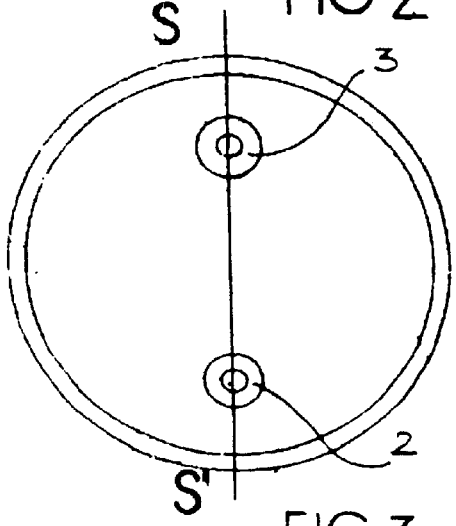
FIG 3

HYPOBARIC CIGARETTE FILTER DEVICE

BACKGROUND OF THE INVENTION

The invention is a device used on cigarettes to retain the tar in tobacco smoke from the cigarette. In particular the device improves the removal of tar from cigarette smoke by way of its hypobaric action.

FIELD OF THE INVENTION

Ordinary cigarette comprising in the filter zone a small (as big as the dimensions of the filtring part permit) a chamber with a hypobaric action suitable for decantation of the tar particles contained in the smoke which, accelerated in the zone of access to the chamber, finds itself in an area of calm and pressure below atmospheric, which thing favours the separation of the largest particles with a mass greater than that of the rest of the smoke, which is drawn by the smoker through the exit hole or holes, leaving within the chamber a quantity estimated on average as 70–80% of the total amount of tar contained in the original smoke In implementing such a device it is obviously necessary not to allow the smoke to take a linear route from the inlet to the outlet of the low pressure chamber. The drawings that follow illustrate some possible solutions by which the above principle of operation can be applied.

Account must be taken of the fact that the principle can be implemented in a multiplicity of forms that make listing impossible. Account must also be taken of the fact that the shape and dimensional ratios may vary according to the various types of tobacco employed, on their specific moisture content and on a series of values including and not least, ambient temperature and humidity.

BRIEF DESCRIPTION OF THE DRAWINGS

FIG. 1 shows a cross-section of a hypobaric chamber in a cigarette according to the invention.

FIG. 2 shows a phantom perspective view of the hypobaric chamber of FIG. 1 which is taken at line A-A'.

FIG. 3 shows a top view of a section A-A' in FIG. 1 where line S-' represents the section A-A'.

DETAILED DESCRIPTION OF THE INVENTION

For the above reasons the following examples must be deemed explicative of the principle of operation which, as illustrated in FIG. 1 use as essential elements a) one or more hypobaric chambers (in which there is a pressure reduction situation) indicated as 1 in FIGS. 1, 2, and 3; b) an access duct to the same which can accelerate the flow of smoke indicated with 2 in the figures; c) an exit duct (or more than one duct) which can again accelerate the flow and put the chamber in a state of reducted pressure indicated with 3 in the figures.

In 1/1 in which FIG. 1 represents a section of a cigarette showing hybobaric chamber 1 and the section S-S' of FIG. 3, which represents the section A-A' of FIG. 1, the section is shown in FIG. 1 of a cigarette provided with the device which in this presentation is positioned between the part containing the tobacco and the conventional filter 5 of cellulose or other material but is evident that the positioning of the device may conveniently also be downstream from the conventional filter or inserted between two or more of such filters or also as the sole filtering element of the cigarette, with the sole limitation to its application being its positioning between the tobacco and the smoker in the direction of the material combusted.

In the example the illustration is limited to the two essential elements of the discovery, in the first place the hypobaric effect decantation chamber, in the second place, the inlet and outlet ducts of the chamber, elements that are indicated with numeral 1 for the chamber and with 2 and 3 for the inlet and outlet ducts of the same. These essential components of the discovery are, in some cases, repeated for a multiplication of the filtering effect even if, from the tests carried out, the reduction of tar condensate obtainable on the first passage through the hypobaric chamber is such as to render superfluous or of little significance a repeated passage of the smoke through multiple devices.

The determinant function of the chamber within which, by virtue of the reduced pressure, the particles of larger mass tend to agglomerate and escape from the not linear route required for the smoke to exit from the chamber, as well as always by virtue of the pressure reduction, with a lowering of the temperature of the component of the smoke such as to constitute a further contribution to isolation of the tar, justifies a study of the volume of the same in relation to the dimensions of the ducts, in relation to the type of tobacco and such other variables as are related to obtain the result required, for this reason ideal or indicative dimensions are not indicated but only the principle by which the device is able to produce the effects desired.

Remarcable results have been obtained with dimensions respectively a) inlet hole 0.5–0.8 mm diameter b) outlet hole 1–2 mm diameter c) hypobaric chamber 0.25–1.5 cc volume In is evident that in any case and according to the application these values can be subject to even large varation.

What is claimed is:

1. A retention device for insertion in the smoke path of a cigarette between the point of combustion and the smoker, apt to remove tar from the smoke by promoting its deposition within said device, said device comprising a chamber defining a longitudinal axis corresponding to the longitudinal axis of the cigarette, comprising two opposing end faces substantially orthogonal to said axis, a smooth surfaced smoke inlet duct formed on the one of said end faces on the side of the point of combustion, and projecting into said chamber, a smooth surfaced smoke outlet duct formed on the one of said end faces on the side of the smoker, and projecting into said chamber out of alignment with the inlet duct, said smoke inlet and outlet ducts being parallel to said axis, wherein the flow area of said first smoke inlet duct is smaller than the flow area of said smoke outlet duct, and both said smoke inlet and outlet ducts taper toward their respective ends placed inside said chamber and both extend more than halfway into said chamber.

2. A retention device according to claim 1, wherein said inlet duct has a diameter in the range of 0.5 to 0.8 mm and the outlet duct has a diameter in the range of 1 to 2 mm.

3. A retention device according to claim 1, wherein said chamber has a volume in the range of 0.25 to 1.5 cubic cm.

4. A retention device according to claim 3, wherein said chamber is of substantially cylindrical shape.

5. A retention device according to claim 4, wherein said retention device is movably attached to a cigarette in a smoke area exit thereof.

6. A retention device according to claim 4, wherein said retention device is an integral part of a cigarette.

* * * * *